US006283587B1

(12) United States Patent
Umemura

(10) Patent No.: US 6,283,587 B1
(45) **Date of Patent: *Sep. 4, 2001**

(54) PRINTER INK CARTRIDGE AND INK CARTRIDGE DEVICE INCLUDING THE SAME

(75) Inventor: Shunji Umemura, Shiojiri (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/270,456

(22) Filed: Mar. 17, 1999

(30) Foreign Application Priority Data

Mar. 20, 1998 (JP) ..... 10-092414
Mar. 20, 1998 (JP) ..... 10-092415

(51) Int. Cl.[7] ..... B41J 2/175
(52) U.S. Cl. ..... 347/86
(58) Field of Search ..... 347/84, 85, 86, 347/87

(56) References Cited

U.S. PATENT DOCUMENTS 5,812,166 * 9/1998 Yamazaki ..... 347/87

FOREIGN PATENT DOCUMENTS 06328712 11/1994 (JP) ..... B41J/2/175
07137274 5/1995 (JP) ..... B41J/2/175
07137277 5/1995 (JP) ..... B41J/2/175
07323565 12/1995 (JP) ..... B41J/2/175
08025640 1/1996 (JP) ..... B41J/2/175

* cited by examiner

*Primary Examiner*—N. Le
*Assistant Examiner*—Anh T. N. Vo
(74) *Attorney, Agent, or Firm*—Hogan & Hartson, L.L.P.

(57) ABSTRACT

An ink cartridge device includes an ink cartridge and a cartridge casing. The ink cartridge has a first surface formed with an ink delivery port, a second surface formed with an air inlet port, a delivery port-sealing film for sealing the ink delivery port, and an air inlet port-sealing film for sealing the air inlet port. The cartridge casing has a casing body and a lid for closing the casing body. The cartridge casing accommodates the ink cartridge. At least one of the delivery port-sealing film and the air inlet port-sealing film comprises an unsealing operation portion for opening the at least one of the delivery port-sealing film and the air inlet port-sealing film, the unsealing operation portion being fixedly attached to an inner surface of the cartridge casing.

15 Claims, 11 Drawing Sheets

PRINTER INK CARTRIDGE AND INK CARTRIDGE DEVICE INCLUDING THE SAME

BACKGROUND OF THE INVENTION

1. Field of the Invention

This invention relates to a printer ink cartridge which is removably loaded in an ink jet printer and an ink cartridge device including the same.

2. Prior Art

FIGS. 11A and 11B show a conventional ink cartridge. The ink cartridge 50 is comprised of a cartridge body 52 having three (YMC) ink reservoirs 51 for holding yellow ink, magenta ink and cyan ink, a delivery port-sealing film 54 for covering ink delivery ports 53 of the cartridge body 52, and an air inlet port-sealing film 57 for covering ink-charging ports 55 and air inlet ports 56 of the cartridge body 52. The three ink-charging ports 55 and three air inlet ports 56 are formed to open in a top surface of the cartridge body 52, and further, meandering air inlet grooves 58 continuous with the respective air inlet ports 56 are formed in the top surface. The air inlet grooves 58 each have its open side (opening) covered with the air inlet port-sealing film 57 (attached to the top surface of the cartridge body 52 by hot-melt bonding) to thereby form air inlet passages 59 in the air inlet grooves 58.

In the above state, the ink cartridge 50 is enclosed in an aluminum package, not shown, for shipment. Ink in the cartridge body 52 is made liable to degradation by exposure to air. To avoid this inconvenience, the ink cartridge 50 has the ink delivery ports 53 thereof sealed (by hot-melt bonding) by the delivery port-sealing film 54, and then, after being charged with ink from the ink-charging ports 55 in a vacuum chamber, the ink-charging ports 55 and air inlet ports 56 are sealed (by hot-melt bonding) by the air inlet port-sealing film 57. In this state, the ink cartridge 50 is vacuum-packed in an aluminum package for supply to the user.

When the ink cartridge 50 is used by the user, first, the aluminum package is unsealed to take out the ink cartridge 50, and thereafter, part (peel-off portion 57*b*) of the air inlet port-sealing film 57 is peeled off, and the air inlet ports 56 (more accurately, upstream ends 59*a* of the air inlet passages 59 continuous with the air inlet ports 56) are opened to the atmosphere, while the delivery port-sealing film 54 is peeled off to open the ink delivery ports 53. In this state, the ink cartridge 50 is loaded in a printer.

The conventional ink cartridge having the above construction suffers from the problem that when the delivery port-sealing film is removed (peeled) off from the cartridge body, ink held in the vicinity of the ink delivery ports may be spilled and ink adhering to the delivery port-sealing film, particularly, a delivery port-sealing portion thereof may touch the user's hand, so that the user's hand, a desk, or the like can be stained with the ink. Further, there is a fear that the user forgets to peel off the delivery port-sealing film and loads the ink cartridge still covered therewith in the printer. Further, the conventional ink cartridge has the inconvenience that since the inside of the cartridge body is in vacuo, air can be mixed into ink to cause a faulty printing operation, unless the films are peeled off in order of the air inlet port-sealing film, first, and then the delivery port-sealing film according to an instruction manual of the ink cartridge supplied to the user.

The meandering portions of the three air inlet passages 59 are formed within an area of two thirds of the top surface of the cartridge body 52, while the upstream ends 59*a* of the air inlet passages 59 extend within an area of the other one third of the same. The air inlet port-sealing film 57 has a non-peel-off portion 57*a* which covers substantially the whole area of the two thirds of the top surface of the cartridge body 52 to close the meandering portions and should not be torn off and a peel-off portion 57*b* which covers a major portion of the remaining area of the other one third to close the upstream ends 59*a*. The non-peel-off portion 57*a* and the peel-off portion 57*b* are connected by a narrow connecting portion crossing over starting portions of the upstream ends 59*a* of the air inlet passages 59 (as a result, the whole air inlet passages 59 including the upstream ends 59*a* is closed). From the peel-off portion 57*b* protrudes a peeling operation portion 57*c* for use in tearing off the peel-off portion. The user holds the peeling operation portion 57*c* between the finger and thumb, and then tears off the peel-off portion 57*b*, thereby opening the upstream ends 59*a* of the air inlet passages 59 to the atmosphere. The user further tears off the delivery port-sealing film 54 to open the ink delivery ports 53, and then loads the ink cartridge 50 in this state in the printer.

The meandering air inlet passages 59 permit air to be supplied to each ink reservoir 51 by the amount corresponding to an amount of ink used or delivered from its ink delivery port 53, while minimizing vaporization of water content of the ink. To use the ink cartridge, therefore, the peel-off portion 57*b* is torn off, thereby opening the upstream ends 59*a* to the atmosphere. When the ink cartridge is shipped or before it is used, however, the upstream ends 59*a* are required to be closed by the air inlet port-sealing film 57. Therefore, to maintain the closed state of the upstream ends 59*a*, perforated lines or the like for guiding a peeling operation are not formed in the narrow connecting portion crossing over the starting portions of upstream ends 59*a* of the air inlet passages 59.

In the case of such a conventional ink cartridge, when the peel-off portion 57*b* of the air inlet port-sealing film 57 is torn off, if the user applies a peeling force in a wrong direction, cutting lines are caused to be displaced particularly at the narrow connecting portion crossing the starting portions of the upstream ends of the air inlet passages, resulting in the peeling of part of the non-peel-off portion (shortened air inlet passages). Or inversely, depending on the arrangement of the three upstream ends, portions to be peeled off cannot be properly peeled off (to cause faulty opening of the air inlet passages). Needless to say, if the upstream ends 59*a* of the air inlet passages 59 are formed in a sufficiently wide area, it is possible to avoid the above inconveniences, unless an extremely erroneous peeling operation is carried out. In this case, however, an area for forming the meandering portions of the air inlet passages is necessarily made small, which makes it impossible to form the air inlet passages such that they have sufficient lengths.

SUMMARY OF THE INVENTION

It is a first object of the invention to provide an ink cartridge device having an arrangement enabling automatic opening of at least one of an ink delivery port-sealing film and an air inlet film which seal an ink cartridge, when the ink cartridge is unpacked.

It is a second object of the invention to provide an ink cartridge device which is capable of reliably unsealing an ink delivery port-sealing film and at the same time prevents ink from being spilled out of the cartridge when the film is unsealed.

It is a third object of the invention to provide an ink cartridge which enables a peel-off portion of a covering film covering an upstream end of an air inlet groove to be accurately peeled off.

To attain the first object, according to a first aspect of the invention, there is provided an ink cartridge device for a printer, including an ink cartridge having a first surface formed with an ink delivery port, a second surface formed with an air inlet port, a delivery port-sealing film for sealing the ink delivery port, and an air inlet port-sealing film for sealing the air inlet port, and a cartridge casing having a casing body and a lid for closing the casing body, the cartridge casing accommodating the ink cartridge.

The ink cartridge device according to the first aspect of the invention is characterized in that at least one of the delivery port-sealing film and the air inlet port-sealing film comprises an unsealing operation portion for opening the at least one the delivery port-sealing film and the air inlet port-sealing film, the unsealing operation portion being fixedly attached to an inner surface of the cartridge casing.

According to this ink cartridge device, the unsealing operation portion is fixedly attached to the inner surface of the cartridge casing. Therefore, when the lid is opened and the ink cartridge is taken out from within the casing body, the unsealing operation portion is automatically pulled whereby at least one of the delivery port-sealing film and the air inlet port-sealing film for which the unsealing operation portion is provided is at least partially peeled off from the ink cartridge.

Particularly to attain the second object, according to a preferred embodiment of the invention, the delivery port-sealing film is formed with a delivery port-unsealing operation portion, the delivery port-unsealing operation portion being fixedly attached to an inner surface of the casing body.

According to this preferred embodiment, the delivery port-unsealing operation portion is fixedly attached to the inner surface of the casing body of the cartridge casing. Therefore, when the lid is opened and the ink cartridge is taken out from within the casing body, the delivery port-unsealing operation portion is automatically pulled whereby the delivery port-sealing film is peeled off from the ink cartridge. Further, when the delivery port-sealing film is peeled off, at least the first surface-side portion of the ink cartridge is still positioned within the cartridge, so that the ink dropped (or spilled) from the ink cartridge is received by the casing body, and the delivery port-sealing film stained with the ink is left within the casing body, thereby preventing the user's hands, the desk and the like from being stained by the ink.

Preferably, the air inlet port-sealing film is formed with an air inlet port-unsealing operation portion, the air inlet port-unsealing operation portion being fixedly attached to the lid.

According to this preferred embodiment, when the lid is opened to take out the ink cartridge, the air inlet port-sealing film is automatically pulled by the air inlet port-unsealing operation portion whereby a portion of the air inlet port-sealing film can be torn off from the ink cartridge.

Further, according to this preferred embodiment, when the air inlet port-sealing film is formed with an air inlet port-unsealing operation portion, and the air inlet port-unsealing operation portion is fixedly attached to the lid, when the lid is opened, the peel-off portion of the air inlet port-sealing film is first pulled off by the air inlet port-unsealing operation portion, and then, when the ink cartridge is taken out from within the casing body, the delivery port-sealing film is pulled off by the delivery port-unsealing operation portion. Thus, the air inlet port and the ink delivery port are made open to the air or caused to be communicated with the outside air in the mentioned order. Therefore, even if the ink cartridge is supplied to a user in a vacuumed-state, air is prevented from being mixed into the ink held therein when the ink cartridge is put into use.

Preferably, the lid is integrally formed with the casing body, and the lid is opened by rotational motion about its side continuous with the casing body.

According to this preferred embodiment, before the lid is completely opened, even if the user attempts to take out the ink cartridge, the ink cartridge is caught by the lid and hence cannot be taken out. On the other hand, when the lid is completely opened, the air inlet-sealing film (peel-off portion thereof) is already torn off. This necessarily causes the peeling-off of the air inlet port-sealing film and the delivery port-sealing film to be carried out in this order. Therefore, even if the ink cartridge is supplied to a user in a vacuumed-state, air is prevented from being mixed into the ink held therein when the ink cartridge is put into use.

Further preferably, the lid has an opening tab formed therewith for opening the lid, the air inlet port-unsealing operation portion is fixedly attached to the opening tab.

According to this preferred embodiment, by pinching and pulling the opening tab, the air inlet port-sealing film (peel-off portion thereof) is automatically torn off simultaneously as the lid is opened. In this case, the air inlet port-unsealing operation portion is fixedly attached to the opening tab, and the user directly pulls the operation portion. This makes it possible to positively or reliably peel off the air inlet port-sealing film even when the lid is low in rigidity.

More preferably, the cartridge casing further includes a retention member for retaining the ink cartridge within the casing body against a peeling opening force applied to the air inlet port-sealing film in accordance with opening of the lid.

According to this preferred embodiment, the ink cartridge is retained in the casing body, and hence when the lid is opened, the air inlet port-sealing film is necessarily torn off. This enables the air inlet port-sealing film and the delivery port-sealing film to be positively torn off and peeled off in this order.

Preferably, the ink cartridge device further includes a package for vacuum-packing therein the cartridge casing containing the ink cartridge, and the cartridge casing is rigid enough to provide space between the cartridge casing and the ink cartridge in a vacuum-packed state of the package.

According to this preferred embodiment, the cartridge casing is rigid enough to provide space between the cartridge casing and the ink cartridge in a vacuum-packed state of the package. Therefore, evacuated space is created between the inner surface of the vacuum-packed cartridge casing and the outer surface of the ink cartridge case, whereby it is possible to prevent a rise in the pressure within the ink cartridge supplied in an internally vacuumed state. This makes it possible to positively prevent the mixing of air into the ink held within the ink cartridge during storage.

Similarly, the ink cartridge device further includes a package for vacuum-packing therein the cartridge casing containing the ink cartridge, and the cartridge casing is formed of corrugated cardboard.

According to this preferred embodiment, evacuated space can be created within walls of the cartridge casing formed by the corrugated cardboard, whereby the evacuated space can be increased. This further contributes to prevention of a rise in the pressure within the ink cartridge supplied in an internally vacuumed state.

Alternatively, the cartridge casing comprises a paper package having the casing body and the lid integrally formed with the casing body, with a belt-like tear-off portion as a dividing zone therebetween.

Alternatively, the cartridge casing comprises a resin package having a resin casing as the casing body and a removable sealing film as the lid.

Alternatively, the cartridge casing comprises a pull-top can having a can body as the casing body and a pull-top lid as the lid.

According to this preferred embodiment, it is possible to enclose the ink cartridge within the cartridge casing, and at the same protect the ink cartridge during transport of the same.

To attain the second object, according to a second aspect of the invention, there is provided an ink cartridge device for a printer, including an ink cartridge having a first surface formed with an ink delivery port, a second surface formed with an air inlet port, a delivery port-sealing film for sealing the ink delivery port, and an air inlet port-sealing film for sealing the air inlet port, and a package for containing the ink cartridge, the package having an inner bottom surface.

The ink cartridge device according to the second aspect of the invention is characterized in that the delivery port-sealing film comprises an unsealing operation portion for opening the delivery port-sealing film, the unsealing operation portion being fixedly attached to the inner bottom surface of the package.

According to this ink cartridge device, when the package is unpacked, and then, the ink cartridge is taken out from the package, the unsealing operation portion for opening the delivery port-sealing film is automatically pulled, whereby the delivery port-sealing film is peeled off. Further, when the delivery port-sealing film is peeled off, at least the first surface side portion of the ink cartridge is positioned within the package, and hence the ink dropped (spilled) from the ink delivery port is received by the package.

Preferably, the ink cartridge device includes a cartridge cover provided in a manner such that the cartridge cover exists between the ink cartridge and the package, and the ink cartridge has a periphery thereof covered with the cartridge cover, and the cartridge cover is fixedly attached to at least one of the unsealing operation portion and the inner bottom surface of the package.

According to this preferred embodiment, even if the package is formed of a soft material, the ink cartridge can be protected by the cartridge cover. Further, when the ink cartridge is vacuum-packed, it is possible to form a evacuated space by the cartridge cover. Further, since the cartridge cover and the delivery port-sealing film are left within the package, it is possible to easily dispose of them.

To attain the third object, according to a third aspect of the invention, there is provided an ink cartridge for a printer, including a cartridge body having a surface formed with a meandering air inlet groove, and a covering film melt-bonded to the surface of the cartridge body to cover opening of the air inlet groove to thereby form an air passage in the air inlet groove for introducing air into the cartridge body, the covering film having a peel-off portion arranged on an upstream end portion of the air passage, for being peeled off when the ink cartridge is put into use, to thereby open the upstream end of the air passage.

The ink cartridge according to the third aspect of the invention is characterized in that the covering film is formed of a uniaxially oriented film arranged in a manner such that a direction of orientation of the uniaxially oriented film and a direction of peeling of the peel-off portion agree with each other.

According to this ink cartridge, the covering film is formed of a uniaxially oriented film arranged in a manner such that a direction of orientation of the uniaxially oriented film and a direction of peeling of the peel-off portion agree with each other. Therefore, in an attempt to tear off the peel-off portion, when the user fails to apply his force to the film in a suitable direction, the peel-off portion can be properly torn off such that the torn-off portion has a predetermined width. Therefore, the location of the peel-off portion, which may be invisible to the user, can be set accurately, and accordingly, the air inlet passage can be formed without considering a variation in a torn off area of the film. Further, it is not necessary to provide a peel-off portion and a non peel-off portion as respective separately-shaped portions, and hence the process for preparing the covering film can be simplified.

Preferably, the covering film has a peeling operation portion formed in a protruding manner and continuous with a peeling-initiating end of the peel-off portion.

According to this preferred embodiment, by pulling the peeling operation portion which is protruding, it is possible to tear off the peel-off portion accurately such that it has a width of a portion where the peeling operation portion meets a main part of the film.

Alternatively, the ink cartridge further includes a belt-like peeling operation member for peeling the peel-off portion, the peeling operation member has an end thereof fixed to an upper surface of the peel-off portion along the direction of peeling of the peel-off portion.

According to this preferred embodiment, in place of the peeling operation portion, by fixedly attaching the belt-like peeling operation member to the upper surface of the peel-off portion, by pulling the peeling operation member, it is possible, similarly to the above, to tear off the peel-off portion accurately such that it has a width of a portion where the peeling operation portion meets a main part of the film.

More preferably, one end of the peel-off portion in the direction of peeling thereof faces one side of the covering film and another end of the peel-off portion faces a precut slit formed in the covering film.

According to this preferred embodiment, the length of the peel-off portion can be set to a distance from the one side of the covering film to the precut slit. Therefore, the area of the peel-off portion can be reduced without spoiling the function thereof. Further, an area where the meandering portion of the air inlet passage is formed can be expanded as the area of the peel-off portion is reduced.

The above and other objects, features, and advantages of the invention will become more apparent from the following detailed description taken in conjunction with the accompanying drawings.

DETAILED DESCRIPTION

The invention will now be described in detail with reference to drawings showing embodiments thereof.

Figure 1:
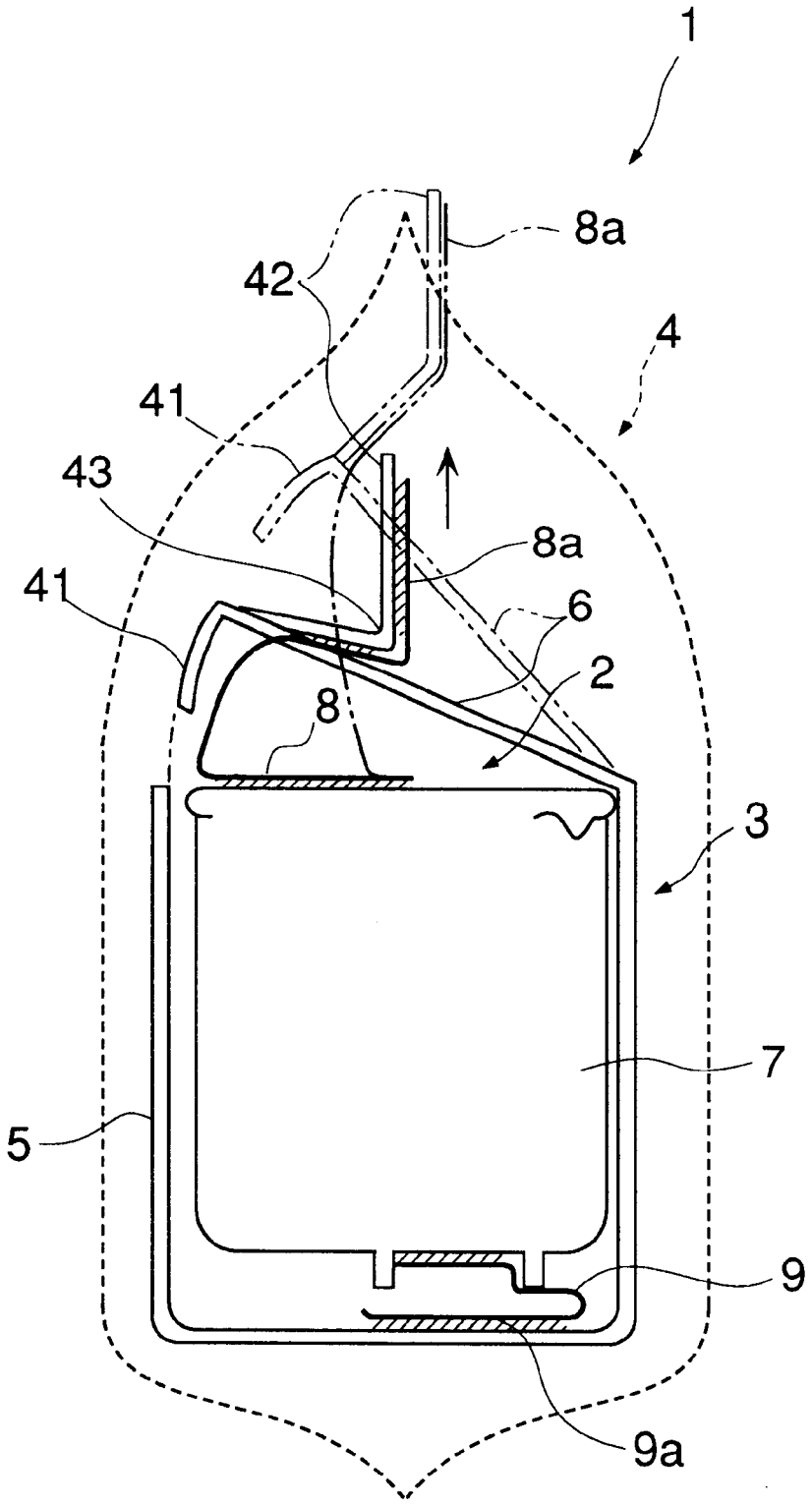
FIG. 1 is a cross-sectional view of an ink cartridge device according to a first embodiment of the invention.

Referring first to FIG. 1, there is shown an ink cartridge device for a printer, in cross section, according to a first embodiment of the invention. The ink cartridge device 1 is comprised of an ink cartridge 2 filled with yellow ink, magenta ink, cyan ink and black ink, a cartridge casing 3 for accommodating the ink cartridge 2, and a package 4 for enclosing the cartridge casing 3. The cartridge casing 3 includes a casing body 5, and a lid 6 integrally formed with the casing body 5 in a manner such that the casing body 5 can be closed and opened by the lid 6. The ink cartridge 2 includes a cartridge body 7, an air inlet port-sealing film 8 attached to a top surface of the cartridge body 7 by hot-melt bonding and a delivery port-sealing film 9 attached to a back surface of the cartridge body 7 by hot-melt bonding.

The air inlet port-sealing film 8 has one end thereof bonded to the lid 6 of the cartridge casing 3, while the delivery port-sealing film 9 has one end thereof bonded to the casing body 5 of the cartridge casing 3, whereby when the package 4 is unsealed to take out the cartridge casing 3 and the lid 6 of the cartridge casing 3 is opened, (part of) the air inlet port-sealing film 8 is peeled off from the cartridge body 7, and then, when the cartridge body 7 is taken out from the casing body 5 of the cartridge casing 3, the delivery port-sealing film 9 is peeled off from the cartridge body 7, thereby making the ink cartridge 2 ready for being loaded in the printer.

Figure 2:
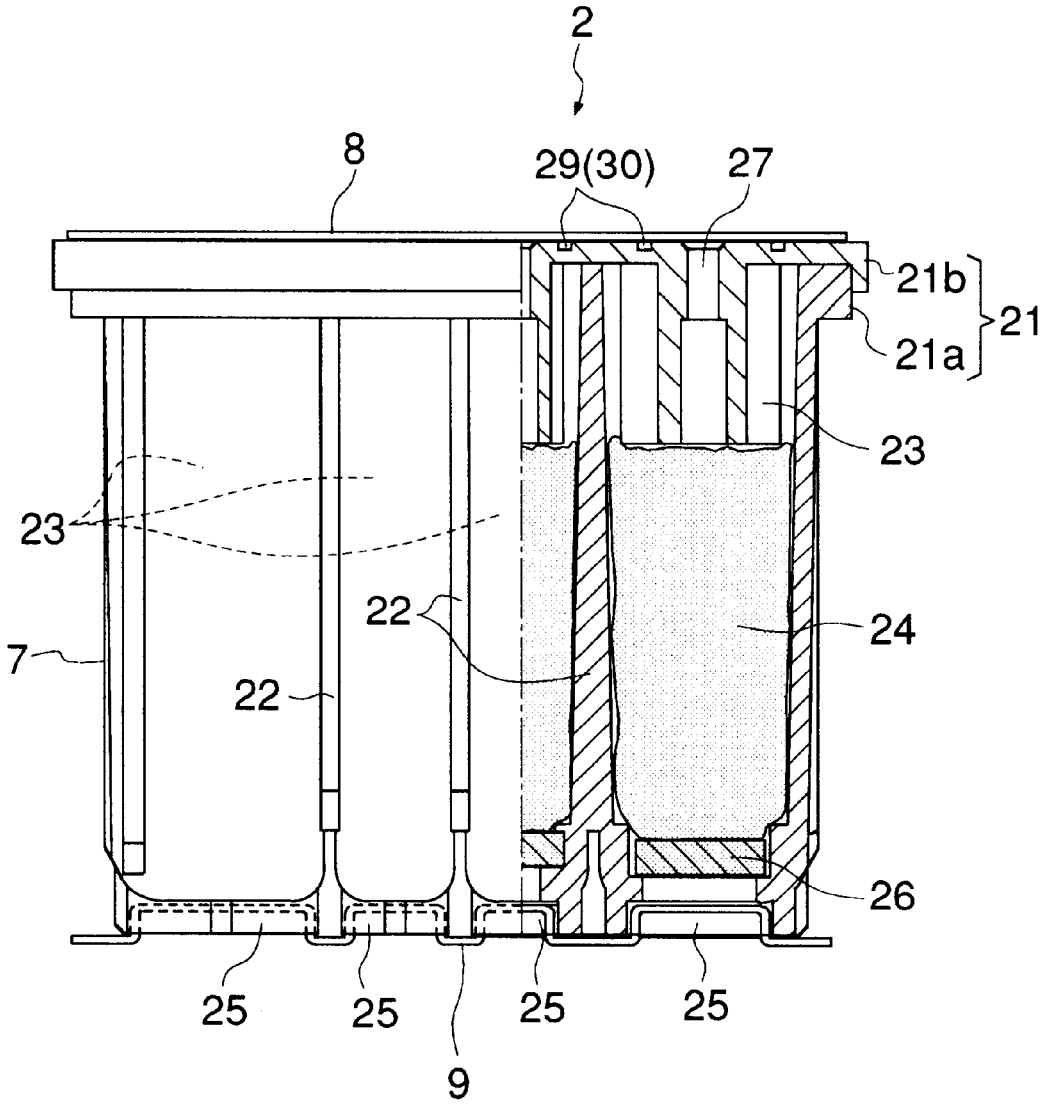
FIG. 2 is a front elevational view, partly in section, showing an ink cartridge appearing in FIG. 1.
Figure 3:
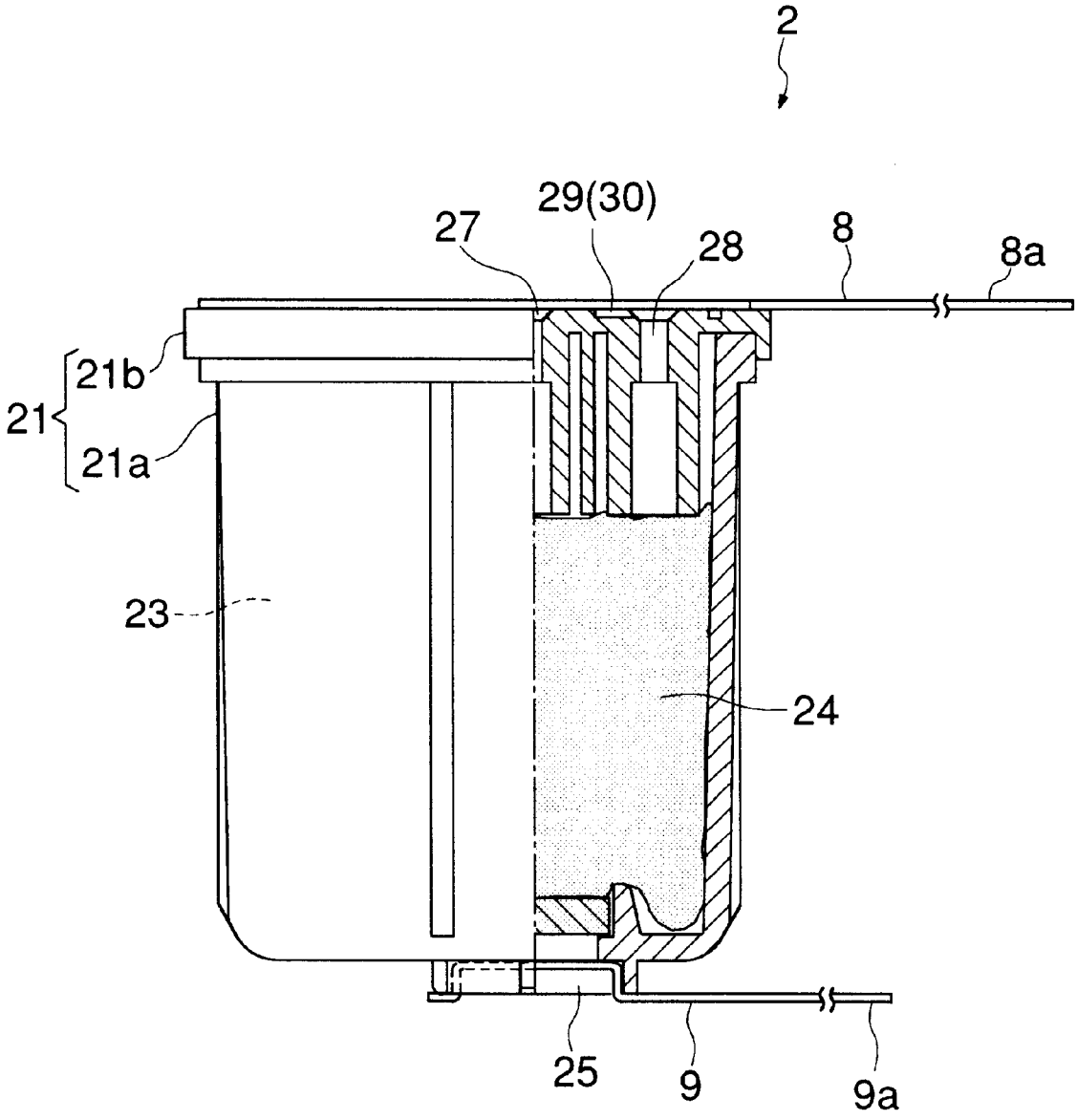
FIG. 3 is a side elevational view partly in section, showing the ink cartridge.
Figure 4:
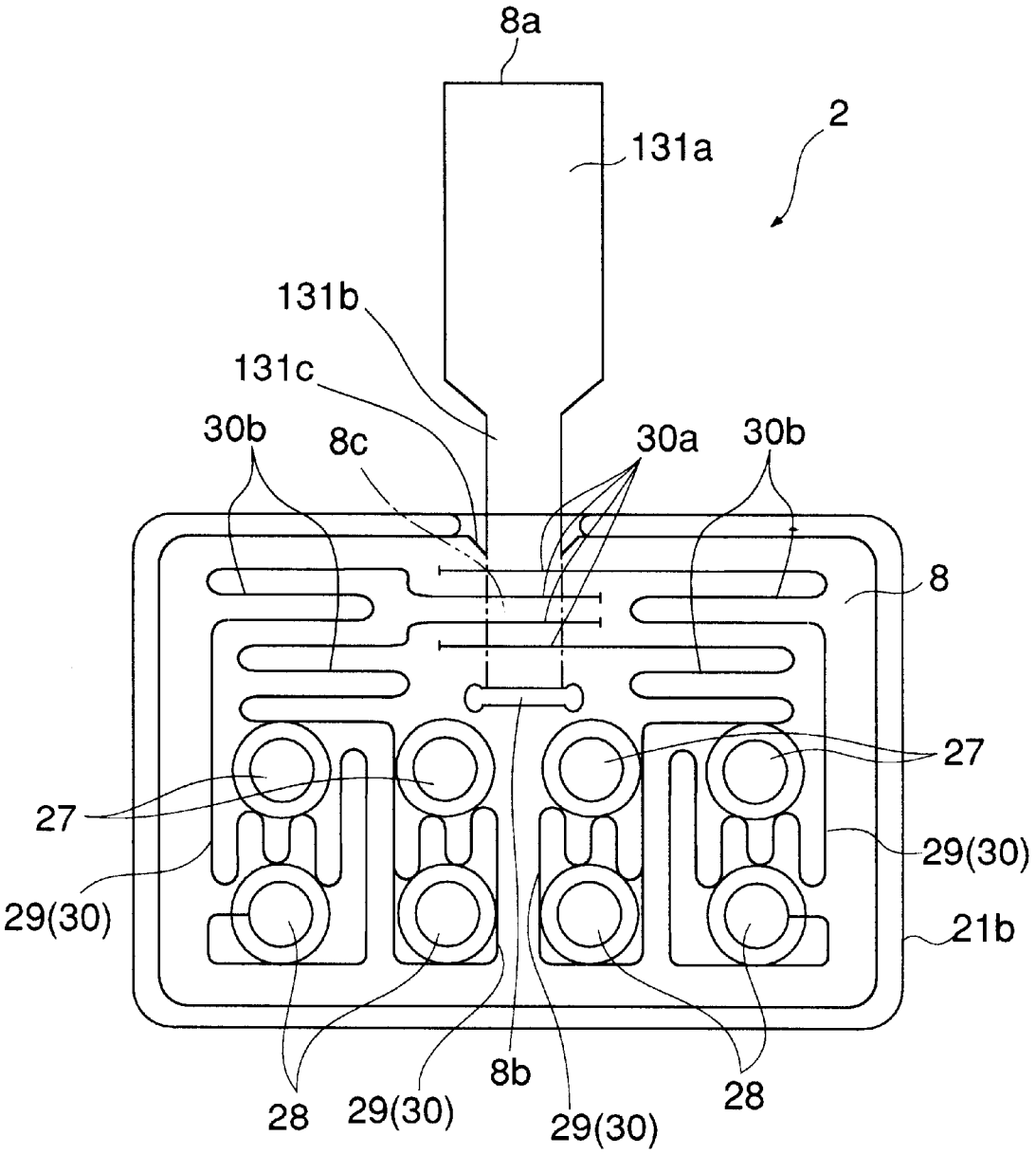
FIG. 4 is a plan view of the ink cartridge.

Referring to FIGS. 2, 3 and 4, the cartridge body 7 of the ink cartridge 2 includes a body casing 21 which is comprised of a lower casing 21*a*, and an upper casing 21*b* arranged in a manner closing the upper opening of the lower casing 21*a*, and has its interior divided by three partition walls 22 extending upward from the bottom of the lower casing 21*a* into four ink reservoirs 23 for holding yellow ink, magenta ink, cyan ink, and black ink. The ink reservoirs 23 are each filled with an ink absorbent 24, and the four colors of ink charged into the ink cartridge 2 are stored in the respective ink reservoirs 23 in a state absorbed in the ink absorbents 24.

The lower casing 21*a* has a bottom thereof formed with four ink delivery ports 25 leading to the four ink reservoirs 23. There is provided a filter 26 between each ink delivery port 25 and each ink absorbent 24. To the back surface of the lower casing 21*a* is removably affixed by hot-melt bonding the delivery port-sealing film 9 for collectively sealing the four ink delivery ports 25. As described above, when the ink cartridge 2 is used, the delivery port-sealing film 9 is peeled off in accordance with the operation of taking out the ink cartridge 2 from the cartridge casing 3, and the ink delivery ports 25 is made open (unsealed). To this end, the delivery port-sealing film 9 is formed with an unsealing operation portion 9*a* which extends lengthwise in one direction and is fixedly attached (bonded) to the inner bottom surface of the casing body 5 of the cartridge casing 3 in a manner folded back (see FIG. 1). Further, the folded-back portion (loosened portion) of the unsealing operation portion 9*a* is set to such a length that the delivery port-sealing film 9 is peeled off before the ink cartridge 2 is completely drawn out from the casing body 5.

On the other hand, the upper casing 21*b* has four circular ink-charging ports 27 and four air inlet ports 28 formed therethrough in a manner corresponding to the respective ink delivery ports 25 of the lower casing 21*a*. Further, the upper casing 21*b* has a top surface formed with four air inlet grooves 29 whose downstream ends lead to the four air inlet ports 28, respectively. Each air inlet groove 29 is formed in a manner meandering over the top surface of the upper casing 21*b* so as to provide a long path through which air is permitted to flow into the ink cartridge 2. The four air inlet grooves 29 have respective upstream ends extending to a center of the top surface of the upper casing 21*b* in parallel with each other.

The top surface of the upper casing 21*b* is designed such that the air inlet port-sealing film 8 is removably affixed thereto by hot-melt bonding in a manner covering (sealing) the upper openings of the ink-charging ports 27, the air inlet ports 28, and the air inlet grooves 29, from above. The air inlet port-sealing film 8 and the four air inlet grooves 29 define four air inlet passages 30 leading to the respective ink reservoirs 23 via the air inlet ports 28. That is, the four air inlet passages 30 have their upstream ends 30*a* arranged in parallel with each other at a location near one side in a longitudinal center of the top surface of the upper casing 21*b*, and downstream ends thereof communicating with the air inlet ports 28 respectively via the upstream ends 30*a* and meandering portions 30*b* thereof. The meandering air inlet passages 30 permit the air inlet ports 28 of the respective ink reservoirs 23 to be communicated with the atmosphere, and at the same time minimize vaporization of water content of the ink via the air inlet passages 30.

The air inlet port-sealing film 8 is formed of a uniaxially oriented film, and from a portion thereof facing the upstream ends 30*a* of the air inlet passages 30, a peeling operation portion (unsealing operation portion) 8*a* for use in peeling off the air inlet port-sealing film 8 protrudes in a manner arranged at right angles to the air inlet port-sealing film 8. The peeling operation portion 8*a* is comprised of a tab 131*a* having a large width, and a connection portion 131*b* having a small width and continuous with the tab 131*a*. The connection portion 131*b* has a root portion meeting a pair of wedge-shaped cutouts 131*c* formed in a side edge of the air inlet port-sending film 8, for guiding the start of peeling of a peel-off portion 8*c*, described hereinafter. Further, the air inlet port-sealing film 8 has a precut slit 8*b* formed at a location opposite to the peeling operation portion 8*a* with the upstream ends 30*a* of the air inlet passages 30 being positioned between the precut slit 8*b* and the peeling operation portion 8*a*. The precut slit 8*b* is arranged in a manner extending in parallel with the upstream ends 30*a*, and has opposite outer ends thereof formed substantially circular in shape so as to prevent the air inlet port-sealing film 8 from being torn from the outer ends.

When the ink cartridge 2 is put into use, in accordance with the operation of opening the lid 6 of the cartridge casing 3, the peel-off portion 8*c* in the form of a band starting from the root portion of the peeling operation portion 8*a* up to the precut slit 8*b* is peeled off, whereby the air inlet ports 28 (more accurately, the upstream ends 30*a* of the air inlet passages 30) are opened (unsealed). To this end, the peeling operation portion 8*a* of the air inlet port-sealing film 8 is fixedly attached (bonded) to an upward facing surface (originally inner surface a portion (opening tab 42) of the lid 6 folded back on the outer or top surface of the lid 6 such that the originally inner surface faces upward) of the lid 6 of the cartridge casing 3 in a manner folded back, as viewed in FIG. 1.

Figure 5:
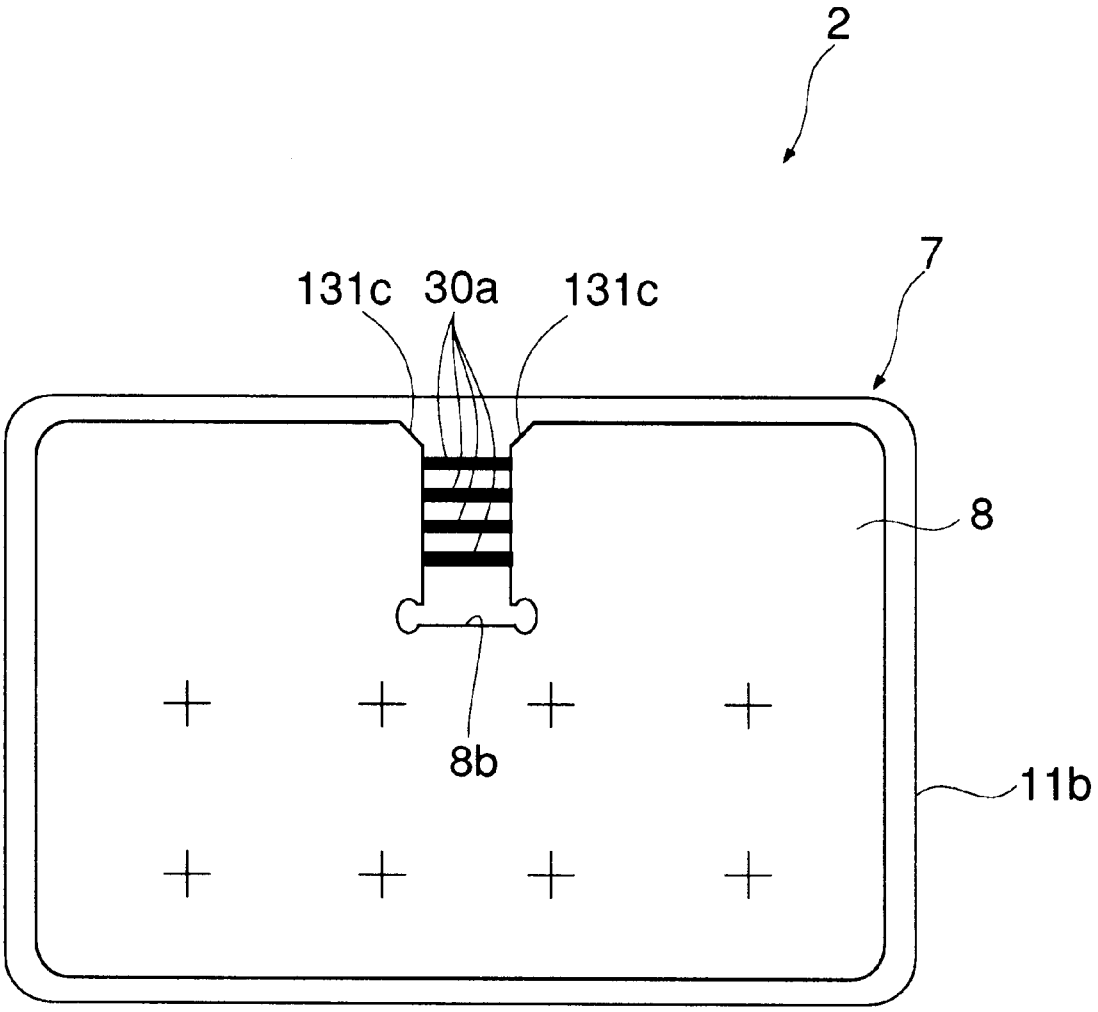
FIG. 5 is a plan view of the ink cartridge, in which an air inlet port-sealing film has a peel-off portion thereof peeled off.

As described above, the air inlet port-sealing film 8 formed of a uniaxially oriented film is affixed to the top surface of the upper casing 21*b* by hot-melt bonding. In other words, the peel-off portion 8*c* having a length from the root portion of the peeling operation portion 8*a* to the precut slit 8*b* and a width identical to the width of the connection portion 131*b* of the peeling operation portion 8*a* is formed (portion indicated by phantom lines in FIG. 4), and this peel-off portion 8*c* is peeled off when the ink cartridge is used, whereby the upstream ends 30*a* of the air inlet passages 30 are made open. More specifically, as shown in FIGS. 4 and 5, the tab 131*a* of the peeling operation portion 8*a* is picked up to pull the same toward the precut slit 8*b*, whereby the air inlet port-sealing film 8 starts to be torn from the pair of wedge-shaped cutouts 131*c* continuous with the connection portion 131*b* and at the same time the peel-off portion 8*c* starts to be peeled off. The torn opening of the air inlet port-sealing film 8 thus formed develops linearly toward the precut slit 8*b* until it reaches the precut slit 8*b*, and when it reaches the precut slit 8*b*, the peel-off portion 8*c* is completely peeled off from the upper casing 21*b*.

As described above, according to the present embodiment, the air inlet port-sealing film 8 of the ink cartridge 2 is formed of a uniaxially oriented film, and affixed to the upper casing 21*b* by hot-melt bonding in a manner such that the direction of orientation of the film and the direction of peeling of the same agree with each other. Hence, it is possible to accurately peel off a portion of the peel-off portion 8*c* having a desired size without necessitating provision of any perforated lines, scored lines or cutouts. Therefore, the position of the peel-off portion 8*c* can be accurately set or determined, which makes it possible to set the positions (and areas) of the meandering portions 30*b* and upstream ends 30*a* of the air inlet passages 30 without taking a possibility of irregular peeling of the peel-off portion 8*c* into consideration. At the same time, since the peel-off portion 8*c* can be accurately peeled off and the area of the same can be minimized to open the upstream ends 30*a*, it is possible to widen areas for forming the meandering portions 30*b* of the air inlet passages 30 and sufficiently lengthen the length of the meandering portions 30*b*. At the same time, even if the cartridge body 7 is designed compact, the meandering portions can be of sufficient length.

Referring again to FIG. 1, the package 4 is a so-called aluminum package formed of a laminate of a resin film and an aluminum film. The cartridge casing 3 containing the ink cartridge 2 is vacuum-packed in the package 4. Therefore, although in the figure the package 4 is shown inflated, actually the inner surface thereof is in substantially intimate contact with the cartridge casing 3. The ink cartridge 2 is supplied to the user with the ink reservoirs therein 23 reduced in pressure, so as to prevent air from mixing into ink in the ink reservoirs 23 during transportation. To maintain the reduced pressure, the ink cartridge 2 is supplied in a vacuum-packed state.

On the other hand, the cartridge casing 3 is constructed by cutting out a flat or pre-folded corrugated cardboard and constructing the cut-out cardboard into the shape of a box. The cartridge casing 3 is comprised of the casing body 5 and the lid 6 integrally formed with the casing body 5, for bendably closing the top opening of the casing body 5. The lid 6 has one end formed with a bend 41 for insertion into the casing body 5 to close the lid 6, such that the bend 41 is fit in the casing body 5. Further, at a central portion of the lid 6 is formed a U-shaped scored line marked or cut from a root portion of the bend 41. A portion surrounded by the scored line forms an opening tab 42. At an intermediate position of the opening tab 42 is formed a bending line 43 along which a half of the opening tab 42 is bent or folded upward. The above peeling operation portion 8*a* of the air inlet port-sealing film 8 has one end bonded to the originally inner surface of the opening tab 42.

The cartridge casing 3 is closed by its lid 6 with the ink cartridge 2 received therein, and enclosed in the package 4 with the half of the opening tab 42 bent upward. Accordingly, after taking out the cartridge casing 3 from the package 4, the lid 6 is opened by picking up and pulling the opening tab 42 of the cartridge casing 3 and simultaneously the peeling operation portion 8*a* connected to the opening tab 42 is pulled to peel off the peel-off portion 8*c* of the air inlet port-sealing film 8 from the cartridge body 7. Then, when the ink cartridge 2 is drawn out from the cartridge casing 3, the unsealing operation portion 9*a* of the delivery port-sealing film 9 is drawn to thereby peel off the delivery port-sealing film 9 from the cartridge body 7.

Now, when the lid 6 is opened, the user picks up the opening tab 42 with one hand. The lid 6 is closed and opened not by mounting and removing of the same but by rotation thereof about one side edge thereof continuous to the casing body 5, so that unless the lid 6 is completely opened, the ink cartridge 2 is caught in the root portion of the lid 6, thereby preventing the ink cartridge 2 from being drawn out from the casing body 5. Inversely, when the lid 6 is completely opened, (the peel-off portion 8*c* of) the air inlet port-sealing film 8 is already peeled off from the cartridge body 7. Actually, as the opening tab 42 is pulled up, the air inlet port-sealing film 8 is progressively peeled off, and when the lid 6 is approximately half opened, the air inlet port-sealing film 8 is completely peeled off (see phantom lines in FIG. 1). Hence, during opening of the lid 6, the ink cartridge 2 cannot be drawn out from the casing body 5, although (the peel-off portion 8*c* of) the air inlet port-sealing film 8 is not peeled off. This inevitably ensures that the films are automatically peeled off (unsealing operations therefor are carried out) in order of (the peel-off portion 8*c* of) the air inlet port-sealing film 8 and the delivery port-sealing film 9.

As described above, in the ink reservoirs 23 is reduced in pressure or in vacuo, and hence if the delivery port-sealing film 9 is first unsealed, air is directly blown into ink from the ink delivery ports 25. As a result, air is mixed into ink, thereby interfering with printing operations. By peeling off the air inlet port-sealing film 8 first, it is possible to avoid such an inconvenience.

Further, there is a fear that with the lapse of time, the ink cartridge 2 having the ink reservoirs 23 under reduced pressure is increased in pressure to atmospheric pressure as an upper limit thereof (due to air leakage therein on a molecular level). Hence, as described above, the ink cartridge 2 is vacuum-packed in the package 4. But, when the ink cartridge 2 and the package 4 are in absolute contact with each other, the ink cartridge 2 per se is deformed under atmospheric pressure (the capacity of the ink reservoirs 23 is reduced) to substantially increase the pressure in the ink reservoirs 23. If the cartridge casing 3 made of corrugated cardboard is interposed between the ink cartridge 2 and the package 4 as in the present embodiment, there can be produced exhausted space (secondary space reduced in pressure) between the package 4 and the cartridge casing 3 and between the cartridge casing 3 and the ink cartridge 2, to eliminate the above inconvenience. Moreover, space within the thick corrugated cardboard also becomes exhausted space, and the capacity of the exhausted space can be sufficiently large, which makes it possible to effectively prevent increase of the pressure in the ink reservoirs 23.

As described above, according to the present embodiment, the ink cartridge 2 is vacuum-packed in the package 4 in a state received in the cartridge casing 3, whereby it is possible to effectively prevent increase of the pressure in the ink reservoirs 23 as well as prevent mixture of air into ink during storage.

Further, the peeling operation portion 8*a* of the ink cartridge 2 is fixedly attached to the lid 6 of the cartridge casing 3, while the unsealing operation portion 9*a* of the ink cartridge 2 is fixedly attached to the casing body 5 of the cartridge casing 3, so that (the peel-off portion 8*c* of) the air inlet port-sealing film 8 and the delivery port-sealing film 9 can be automatically peeled off in accordance with opening of the lid 6 and removal of the ink cartridge 2 from the casing body 5, and what is more in order of the air inlet port-sealing film 8 and the delivery port-sealing film 9. Therefore, the user can peel off the films easily and properly without heed to manners of the peeling operations. This prevents the user from failing to peel off the films as well as making errors in the peeling order, whereby it is possible to prevent mixture of air into ink in accordance with peeling operations.

Moreover, when the delivery port-sealing film 9 is peeled off (the ink delivery ports 25 is unsealed), the ink cartridge 2 is held in the casing body 5 of the cartridge casing 3, so that even if ink is scattered or spilled from the ink delivery ports 25 in accordance with peeling of the delivery port-sealing film 9, the scattered or spilled ink is received within the casing body 5. Further, since the delivery port-sealing film 9 is left in the casing body 5, ink adhering to delivery port-sealing portions of the delivery port-sealing film 9 can also be confined within the casing body 5. Accordingly, it is possible to prevent the user's hands or a desk from being stained with ink, when the delivery port-sealing film 9 is peeled off.

Figure 6:
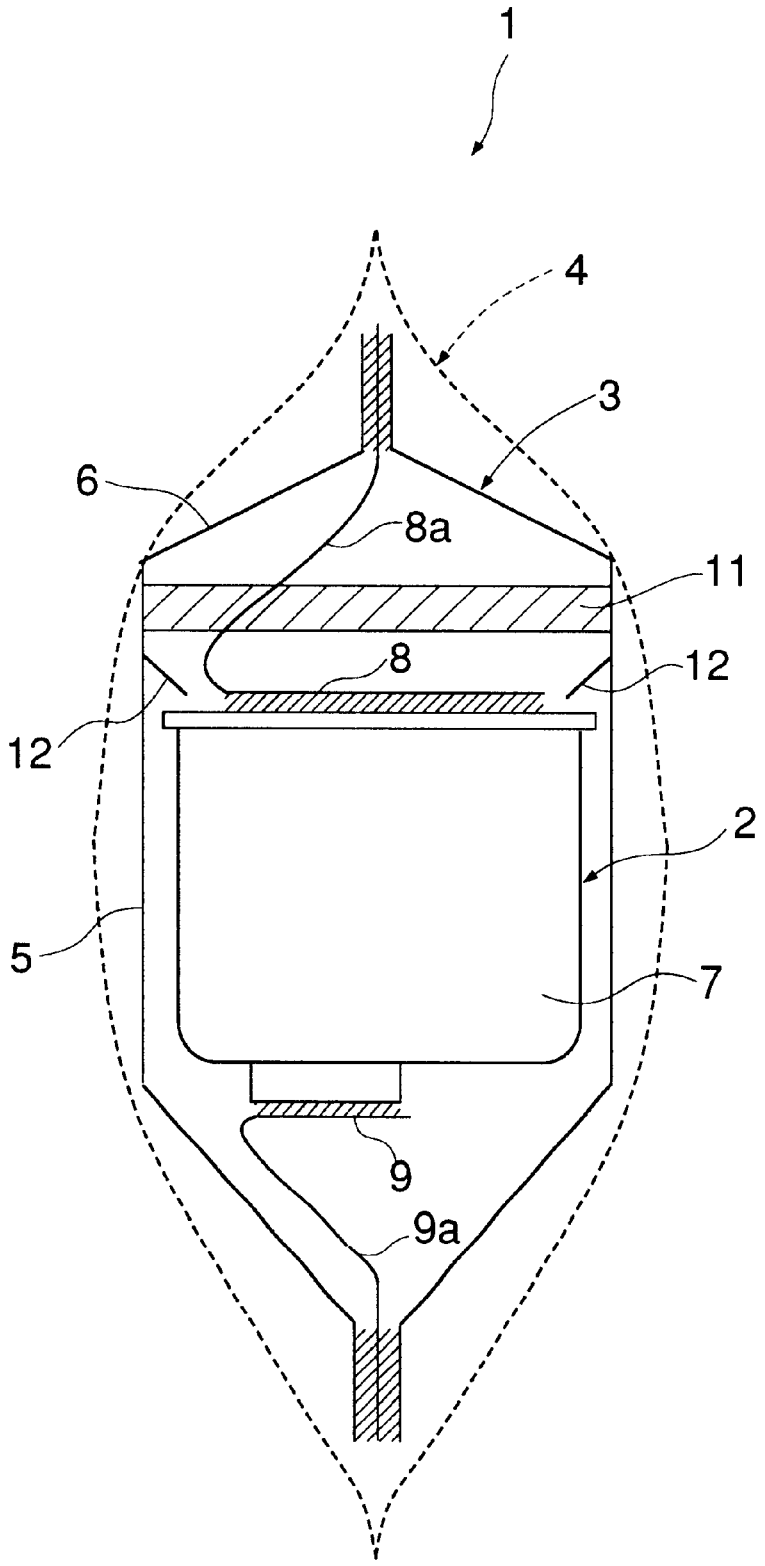
FIG. 6 is a cross-sectional view of an ink cartridge device according to a second embodiment of the invention.

Next, a second embodiment of the invention will be described with reference to FIG. 6. In the following description of the second embodiment, component parts and elements corresponding to those of the first embodiment are indicated by the same reference numerals and detailed description of features other than characterizing features of the present embodiment is omitted.

In this embodiment, the cartridge casing 3 is comprised of a so-called paper package. The cartridge casing 3 is comprised of a casing body 5 and a lid 6 integrally formed therewith, with a belt-like removable sealing portion 11 forming a dividing zone therebetween. The casing body 5 and the lid 6 are separated by unsealing the removable sealing portion (tear-off portion) 11, which makes it possible to open the lid 6 as well as take out the ink cartridge 2. In this embodiment, the air inlet port-sealing film 8 has a peeling operation portion 8*a* fixedly held by a sealed portion at an upper part of the lid 6, while the delivery port-sealing film 9 has an unsealing operation portion fixedly held by a sealed portion at a lower part of the casing body 5.

Further, the casing body 5 has a pair of stoppers (holding members) 12 arranged in a manner projecting bendably and obliquely downward from an inner surface of an upper peripheral portion thereof. When the lid 6 is opened, the stoppers 12 prevent the ink cartridge 2 from being drawn out from the casing body 5 with the air inlet port-sealing film 8 being not peeled off.

According to this arrangement, when the removable sealing portion 11 is unsealed to open the lid 6, the peeling operation portion 8*a* is pulled to peel off (the peel-off portion 8*c* of) the air inlet port-sealing film 8, and then, when the ink cartridge 2 is drawn out from the casing body 5 against the stoppers 12, the delivery port-sealing film 9 is peeled off. This makes it possible to prevent ink from scattering out of the casing body 5 as well as automatically peel off the films (carry out unsealing operations) in order of the air inlet port-sealing film 8 and the delivery port-sealing film 9.

It should be noted that if a resin film or an aluminum film is affixed to the inner surface of the cartridge casing 3 for enabling vacuum packing, a package 4 can be omitted and the cartridge casing 3 can be used as a so-called item packaging box. Further, it is preferred that the adhesions and adhering areas of the air inlet port-sealing film 8 and the delivery port-sealing film 9 are adjusted to make the force required of peeling (unsealing) the air inlet port-sealing film 8 smaller than that required of peeling (unsealing) the delivery port-sealing film 9. In this case, without the stoppers 12, the air inlet port-sealing film 8 can be peeled off before peeling off the delivery port-sealing film 9.

Figure 7:
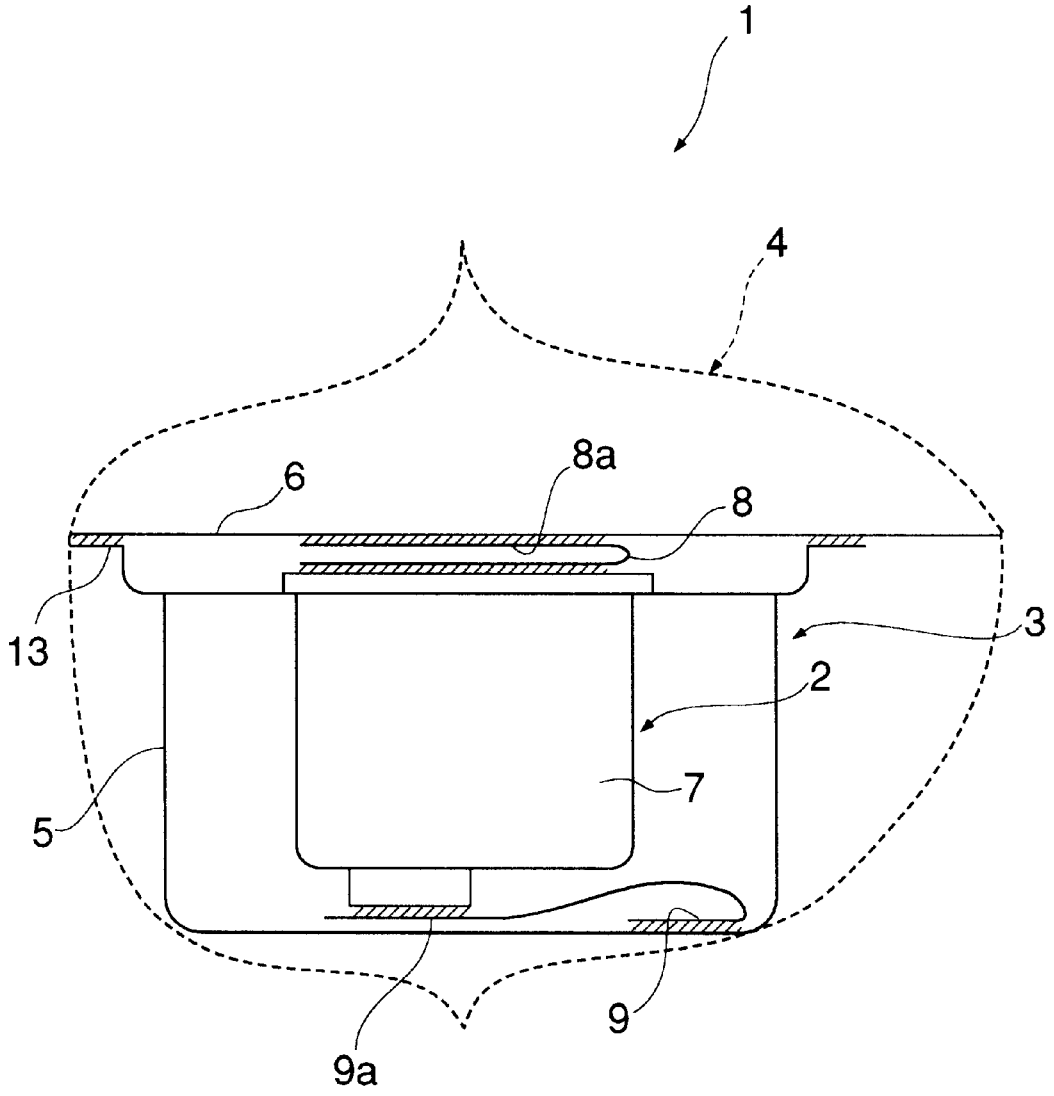
FIG. 7 is a cross-sectional view of an ink cartridge device according to a third embodiment of the invention.

Next, a third embodiment of the invention will be described with reference to FIG. 7. In the following description of the third embodiment, component parts and elements corresponding to those of the first embodiment are indicated by the same reference numerals and detailed description of features other than characterizing features of the present embodiment is omitted.

In this embodiment, the cartridge casing 3 is formed of a resin package. The cartridge casing 3 is comprised of a casing body 5 as a resin case formed by molding of a resin material and a lid 6 as a removable sealing film for closing the top of the casing body 5. The casing body 5 has the top thereof integrally formed with a flanged edge 13 to which the lid 6 is affixed by hot-melt bonding. In the present embodiment, the air inlet port-sealing film 8 has a peeling operation portion 8*a* affixed to an inner surface of the lid 6, while the delivery port-sealing film 9 has an unsealing operation portion 9*a* affixed to a bottom of the casing body 5.

According to this arrangement, when the lid 6 is removed (released) from the casing body 5, the peeling operation portion 8*a* is pulled to peel off (a peel-off portion 8*c* of) the air inlet port-sealing film 8, and then, when the ink cartridge 2 is drawn out from the casing body 5, the delivery port-sealing film 9 is peeled off. Therefore, it is possible to prevent ink from scattering out of the casing body 5 and automatically peel off the films (carry out unsealing operations) in order of the air inlet port-sealing film 8 and the delivery port-sealing film 9.

It should be noted that it is preferable to fill a gap between the casing body 5 and the ink cartridge 2 with any stuff (holding member). If the gap is filled, it is possible to prevent the ink cartridge 2 from being drawn out from the casing body 5 when the lid 6 is opened (the ink cartridge 2 being drawn out from the casing body 5 makes it difficult to peel off the air inlet port-sealing film 8), as well as prevent the ink cartridge 2 from being made unstable in the cartridge casing 3.

Figure 8:
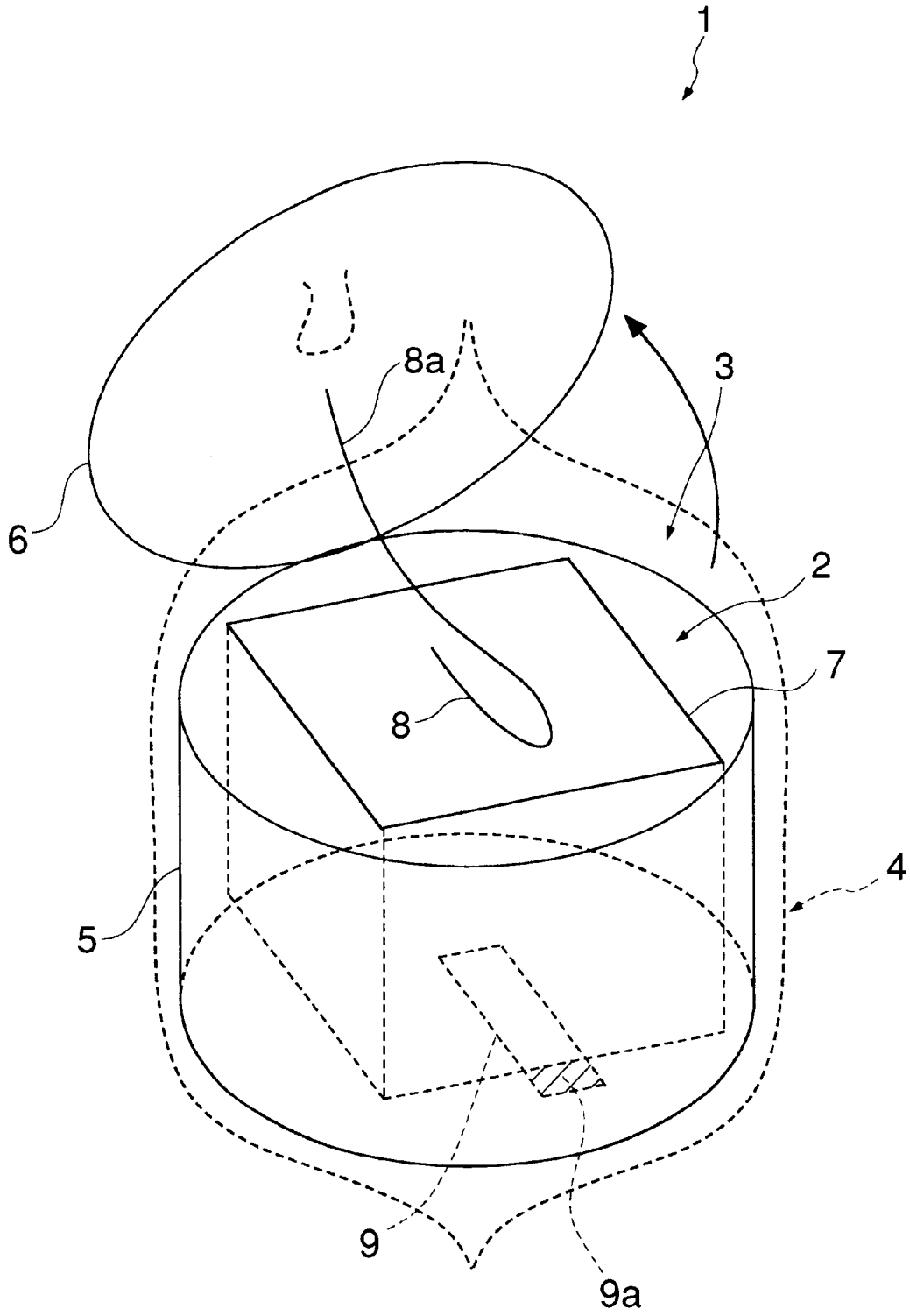
FIG. 8 is a cross-sectional view of an ink cartridge device according to a fourth embodiment of the invention.

Next, a fourth embodiment of the invention will be described with reference to FIG. 8. In the following description of the fourth embodiment, component parts and elements corresponding to those of the first embodiment are indicated by the same reference numerals and detailed description of features other than characterizing features of the present embodiment is omitted.

In this embodiment, the cartridge casing 3 is formed of an aluminum or steel can of a pull top type. The cartridge casing 3 is comprised of a casing body 5 as a can body and a lid 6 of a pull top type. In this embodiment, the air inlet port-sealing film 8 has a peeling operation portion 8*a* affixed to an inner surface of the lid 6, while the delivery port-sealing film 9 has an unsealing operation portion 9*a* affixed to a bottom of the casing body 5.

According to this arrangement, when the lid 6 is released from the casing body 5, the peeling operation portion 8*a* is pulled to peel off (a peel-off portion 8*c* of) the air inlet port-sealing film 8, and then, when the ink cartridge 2 is drawn out from the casing body 5, the delivery port-sealing film 9 is peeled off. Therefore, it is possible to prevent ink from scattering out of the casing body 5 and at the same time automatically peel off the films (carry out unsealing operations) in order of the air inlet port-sealing film 8 and the delivery port-sealing film 9.

Further, in the present embodiment as well, it is preferable to fill a gap between the casing body 5 and the ink cartridge 2 with any stuff (holding member). Furthermore, in this embodiment, it is preferred that the ink cartridge 2 is vacuum-packed in the cartridge casing 3. If the ink cartridge 2 is vacuum-packed, it is possible to dispense with the package 4 (by substituting the can of a pull top type therefor).

Figure 9:
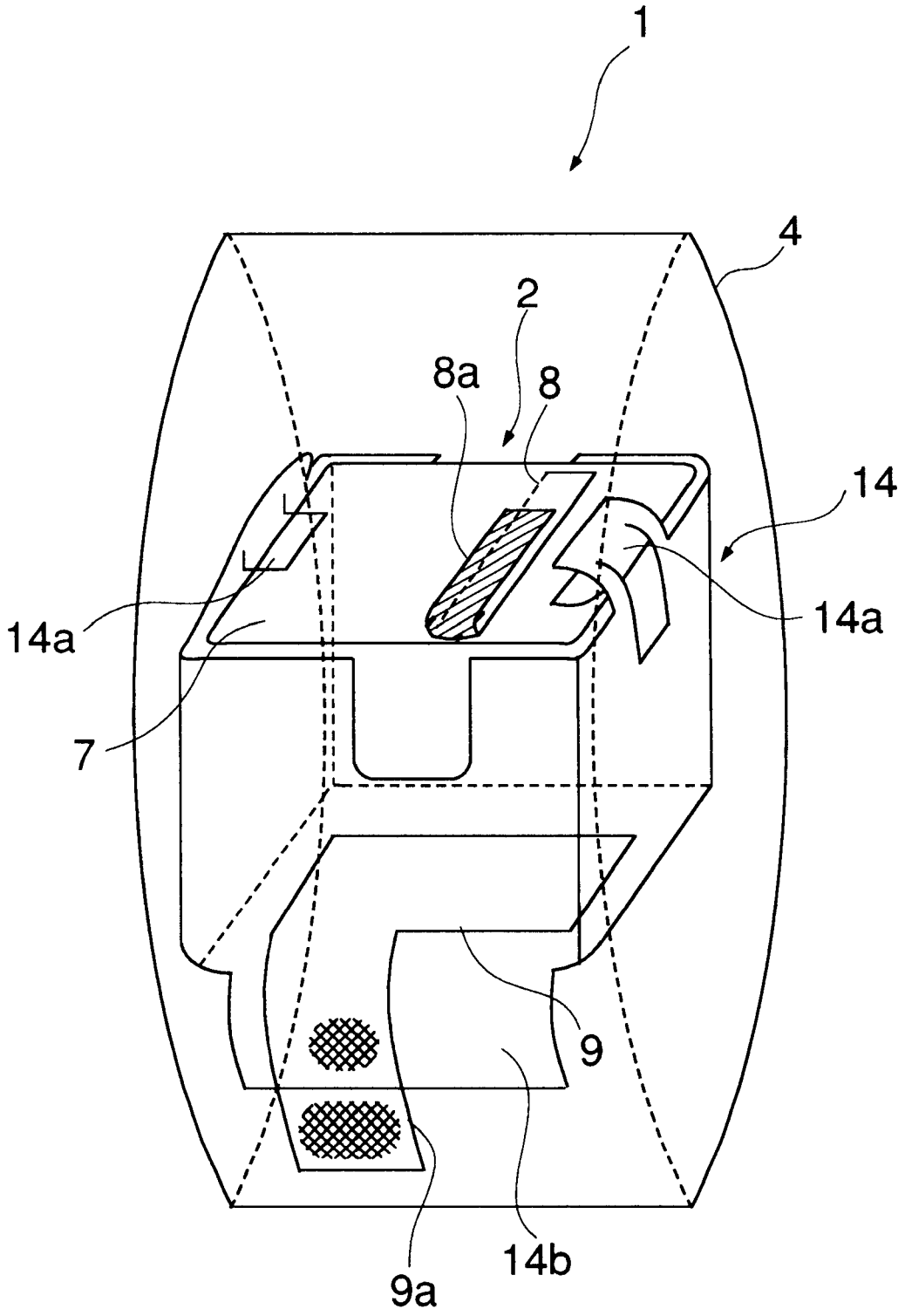
FIG. 9 is a cross-sectional view of an ink cartridge device according to a fifth embodiment of the invention.

Next, a fifth embodiment of the invention will be described with reference to FIG. 9. In the following description of the fifth embodiment, component parts and elements corresponding to those of the first embodiment are indicated by the same reference numerals and detailed description of features other than characterizing features of the present embodiment is omitted.

In this embodiment, there is provided a cartridge cover 14 in place of the cartridge casing 3 in the first embodiment. That is, the ink cartridge 2 has a periphery thereof covered with the cartridge cover 14, and is vacuum-packed in the package 4 in this state. The cartridge cover 14 is constructed by cutting out a flat corrugated cardboard and constructing the cut-out cardboard into the shape of a box without a lid or a bottom such that the ink cartridge 2 can be fitted therein for fixedly holding the same.

At the upper end of the cartridge cover 14 there are formed a pair of stoppers 14*a* by cutting two portions of the upper end and bending the cut portions upward. This enables the ink cartridge 2 to be held within the cartridge cover 14, when the peeling operation portion 8*a* of the air inlet port-sealing film 8 is peeled off. Further, the cartridge cover 14 has a lower end thereof integrally formed with an extending portion 14*b* extending downward from a side thereof. The unsealing operation portion 9*a* of the delivery port-sealing film 9 is fixedly attached to the extending portion 14*b*. Furthermore, the unsealing operation portion 9*a* has a tip thereof affixed to a bottom-side surface of the package 4.

According to this arrangement, by opening the package 4 and pulling the peeling operation portion 8*a*, (a peel-off portion 8*c* of), the air inlet port-sealing film 8 is peeled off, and then, when the ink cartridge 2 is drawn out from the cartridge cover 14 against the stoppers 14*a*, the delivery port-sealing film 9 is peeled off. This makes it possible to prevent ink from scattering out of the package 5 as well as peel off the films (carry out unsealing operations) in order of the air inlet port-sealing film 8 and the delivery port-sealing film 9. In addition, the cartridge cover 14 forms the above-mentioned exhausted space, while being left behind with the delivery port-sealing film 9 in the package 4 when the ink cartridge 2 is taken out, which makes it easy to dispose of the same.

Although in the first to fourth embodiments, the air inlet port-sealing film is automatically peeled off, this is not limitative, but the air inlet port-sealing film may be directly peeled off by the user as in the fifth embodiment. Further, although in the first and fifth embodiments, the cartridge casing and the cartridge cover are made of corrugated cardboard, the corrugated cardboard may be replaced by a cardboard (which means material having rigidity to a certain degree). Furthermore, although the peeling operation portion and the unsealing operation portion are fixedly attached to the underside surface of the lid and the bottom of the casing body, they may be fixedly attached to side walls in the vicinity of the underside surface of the lid and the bottom of the casing body.

Figure 10:
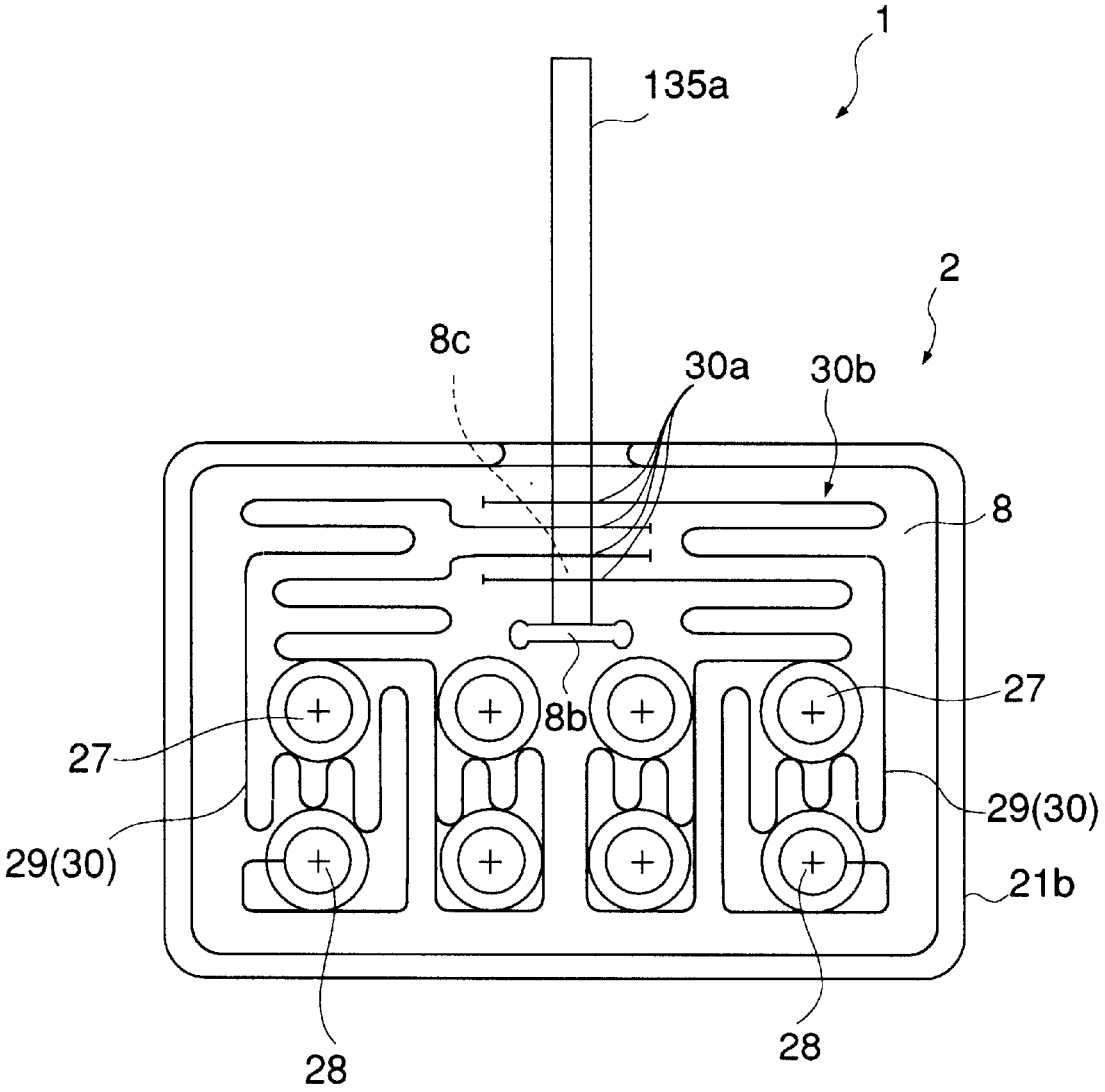
FIG. 10 is a plan view of an ink cartridge device according to a sixth embodiment of the invention.
Figure 11A:
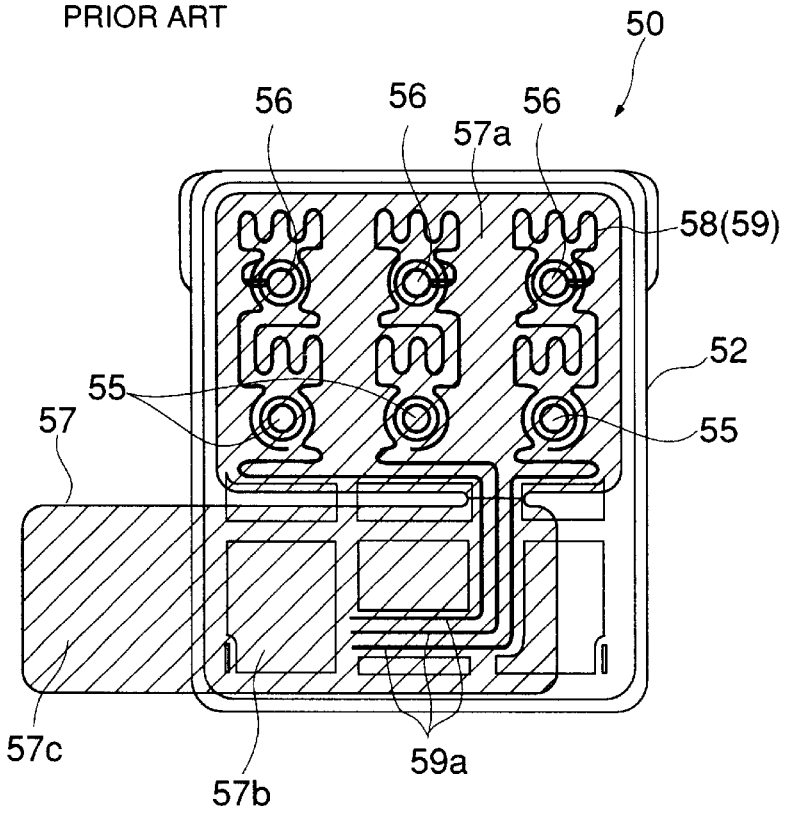
FIG. 11A PRIOR ART
FIG. 11A is a plan view of a conventional ink cartridge.
Figure 11B:
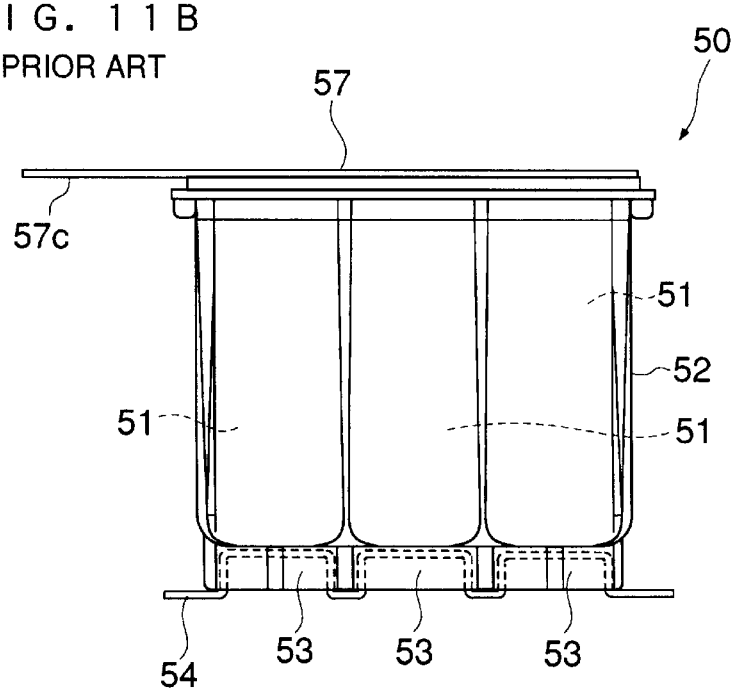
FIG. 11B PRIOR ART
FIG. 11B is a front elevational view of the conventional ink cartridge.

FIG. 10 shows a sixth embodiment of the invention. In the following description of the third embodiment, component parts and elements corresponding to those of the first embodiment are indicated by the same reference numerals and detailed description of features other than characterizing features of the present embodiment is omitted.

In this embodiment, to the air inlet port-sealing film 8 is hot-melt bonded not the peeling operation portion 8*a* but a peeling operation member 135*a*. The peeling operation member 135*a* is band-shaped and has one end thereof hot-melt bonded or bonded to a top surface of the peel-off portion 8*c* in the direction of peeling of the air inlet port-sealing film 8. Therefore, the peeling operation member 135*a* is pulled toward the precut slit 8*b*, whereby the peel-off portion 8*c* is peeled off according to the width of the peeling operation member 135*a*.

It should be noted that in the present embodiment, the peeling operation member 135*a* has a portion thereof corresponding to a pulling tab, arranged in a manner protruding from one side edge of the air inlet port-sealing film 8, so that the peel-off portion 8*c* is peeled off from the one side edge of the air inlet port-sealing film 8 to the precut slit 8*b*. However, the peeling operation member 135*a* can be arranged in a manner protruding from the reverse side, i.e. a precut slit-side end. In such a case, the peel-off portion 8*c* comes to be peeled off from the precut slit-side end to the one side edge of the air inlet port-sealing film 8. Further, although in the present embodiment, the peeling operation member 135*a* is hot-melt bonded along the peel-off portion 8*c*, this is not limitative, but the peel-off portion 8*c* may be hot-melt bonded at a location on the above one side or the side edge of the precut slit 8*b*.

According to the present embodiment, the user can view or confirm a peeling position, which permits him to peel off the peel-off portion 8*c* without a sense of anxiety.

Further, the peel-off portion can be freely arranged. For instance, the peel-off portion can be arranged without forming a precut slit, in a manner extending in a direction transverse to the air inlet port-sealing film. In such a case, the peel-off portion is formed to have a small width and arranged at a position which avoids the meandering portions. Further, if the upstream ends of the air inlet passages are arranged at a corner of the upper casing and the air inlet port-sealing film is hot-melt bonded by setting the direction of orientation of the film to a direction oblique to the direction of peeling of the air inlet port-sealing film, it is possible to peel off a triangular corner portion (triangular peel-off portion) of the air inlet port-sealing film.

It is further understood by those skilled in the art that the foregoing is a preferred embodiment of the invention, and that various changes and modifications may be made without departing from the spirit and scope thereof.

What is claimed is:

1. An ink cartridge device for a printer, including:

an ink cartridge having a first surface formed with an ink delivery port, a second surface opposite the first surface and formed with an air inlet port, a deliver port-sealing film for sealing said ink delivery port, and an air inlet port-sealing film for sealing said air inlet port, and a cartridge casing having a casing body and a lid for closing said casing body, said cartridge casing accommodating said ink cartridge, wherein said delivery port-sealing film includes a delivery port-unsealing operation portion fixedly attached to an inner surface of said casing body for peeling said delivery port-sealing film from the delivery port upon removal of the ink cartridge from the cartridge casing, and said air inlet port-sealing film includes an air inlet port-unsealing operation portion fixedly attached to said lid for peeling said air inlet port-sealing film from said air-inlet port upon opening of said lid.

2. An ink cartridge device according to claim 1, wherein said lid is integrally formed with said casing body, and wherein said lid is opened by rotational motion about a side thereof continuous with said casing body.

3. An ink cartridge device according to claim 1, wherein said lid has an opening tab formed therewith for opening said lid, said air inlet port-unsealing operation portion is fixedly attached to said opening tab.

4. An ink cartridge device according to claim 1, wherein said cartridge casing further includes a retention member for retaining said ink cartridge within said casing body against a peeling opening force applied to said air inlet port-sealing film in accordance with opening of said lid.

5. An ink cartridge device according to claim 1, further including a package for vacuum-packing therein said cartridge casing containing said ink cartridge, and wherein said cartridge casing is rigid enough to provide space between said cartridge casing and said ink cartridge in a vacuum-packed state of said package.

6. An ink cartridge device according to claim 1, further including a package for vacuum-packing therein said cartridge casing containing said ink cartridge, and wherein said cartridge casing is formed of corrugated cardboard.

7. An ink cartridge device according to claim 1, wherein said cartridge casing comprises a paper package having said casing body and said lid integrally formed with said casing body, with a belt-like tear-off portion as a dividing zone therebetween.

8. An ink cartridge device according to claim 1, wherein said cartridge casing comprises a resin package having a resin casing as said casing body and a removable sealing film as said lid.

9. An ink cartridge device according to claim 1, wherein said cartridge casing comprises a pull-top can having a can body as said casing body and a pull-top lid as said lid.

10. An ink cartridge device for a printer, including:

an ink cartridge having a first surface formed with an ink delivery port, a second surface opposite the first surface and formed with an air inlet port, a delivery port-sealing film for sealing said ink delivery port, and an air inlet port-sealing film for sealing said air inlet port, and a package for containing said ink cartridge, said package having an inner bottom surface, wherein said delivery port-sealing film includes a delivery port-unsealing operation portion fixedly attached to said inner bottom surface of said package for peeling said port-sealing film from said delivery port upon removal of the ink cartridge from the package.

11. An ink cartridge device for a printer, including:

an ink cartridge having a first surface formed with an ink delivery port, a second surface opposite the first surface and formed with an air inlet port, a delivery port-sealing film for sealing said ink delivery port, and an air inlet port-sealing film for sealing said air inlet port, and a package for containing said ink cartridge, said package having an inner bottom surface, wherein said delivery port-sealing film includes a delivery port-unsealing operation portion fixedly attached to said inner bottom surface of said package for peeling said port-sealing film from said delivery port upon removal of the ink cartridge from the package, further including a cartridge cover between said ink cartridge and said package, said ink cartridge having a periphery thereof covered with said cartridge cover, and wherein said cartridge cover is fixedly attached to at least one of said unsealing operation portion and said inner bottom surface of said package.

12. An ink cartridge for a printer, including a cartridge body having a surface formed with an air inlet groove of varying direction, and a covering film melt-bonded to said surface of said cartridge body to cover opening of said air inlet groove to thereby form an air passage in said air inlet groove for introducing air into said cartridge body, said covering film having a peel-off portion arranged on an upstream end portion of said air passage, for being peeled off when said ink cartridge is put into use, to thereby open said upstream end of said air passage, wherein said covering film is formed of a uniaxially oriented film arranged such that a direction of orientation of said uniaxially oriented film is the same as a direction of peeling of said peel-off portion.

13. An ink cartridge according to claim 12, wherein said covering film has a peeling operation portion which protrudes from and is continuous with a peeling-initiating end of said peel-off portion.

14. An ink cartridge according to claim 12, further including a belt-like peeling operation member for peeling said peel-off portion, said peeling operation member has an end thereof fixed to an upper surface of said peel-off portion along said direction of peeling of said peel-off portion.

15. An ink cartridge according to claim 12, wherein one end of said peel-off portion in said direction of peeling thereof faces one side of said covering film, and another end of said peel-off portion faces a precut slit formed in said covering film.

* * * * *